United States Patent [19]

Tamir et al.

[11] 3,985,165

[45] Oct. 12, 1976

[54] DOSING APPARATUS

[75] Inventors: Menachem Tamir, Buffalo Grove; Manuel I. Martin, Hoffman Estates, both of Ill.; Robert J. Magill, San Jose, Calif.

[73] Assignee: G. D. Searle & Co., Skokie, Ill.

[22] Filed: July 11, 1975

[21] Appl. No.: 594,984

[52] U.S. Cl. ..... 141/21; 222/145; 259/4 AC

[51] Int. Cl.[2] ..... B65B 29/00; B67D 5/60

[58] Field of Search ..... 222/333, 145, 459; 259/4 R, 4 A, 4 AC, 4 AB; 141/21, 25

[56] References Cited

UNITED STATES PATENTS

| | | | |
|---|---|---|---|
| 3,292,667 | 12/1966 | Bittner et al. | 141/25 |
| 3,643,927 | 2/1972 | Crouch | 259/4 AB |

*Primary Examiner*—Allen N. Knowles
*Assistant Examiner*—Hadd Lane
*Attorney, Agent, or Firm*—Walter C. Ramm; Peter J. Sgarbossa; Albert Tockman

[57] ABSTRACT

A dosing apparatus is provided which is adapted to aspirate and dispense a first fluid in predetermined amounts. The apparatus includes an elongated tubular member which is connected at one end to a reversible pump for imparting controlled reverse flow of a second fluid within the tubular member during aspirating and dispensing of the first fluid from the opposite end of the tubular member. Disposed within the tubular member is an element for inhibiting the intermixing of the two fluids. A plurality of such elements, which are vaned and baffle-like, are disposed within the tubular member and arranged in end-to-end relation. The vanes of successive baffle elements project outwardly towards the interior surface of the tubular member and are curved longitudinally in opposite directions whereby the fluid flow past the baffle elements is subject to abrupt changes in directions at each successive baffle member. Disposed within the tubular member and positioned between the aspirating and dispensing end and the endmost baffle element is a deflector piece which deflects the aspirated fluid towards the interior surface of the tubular member before the fluid contacts the baffle elements.

11 Claims, 8 Drawing Figures

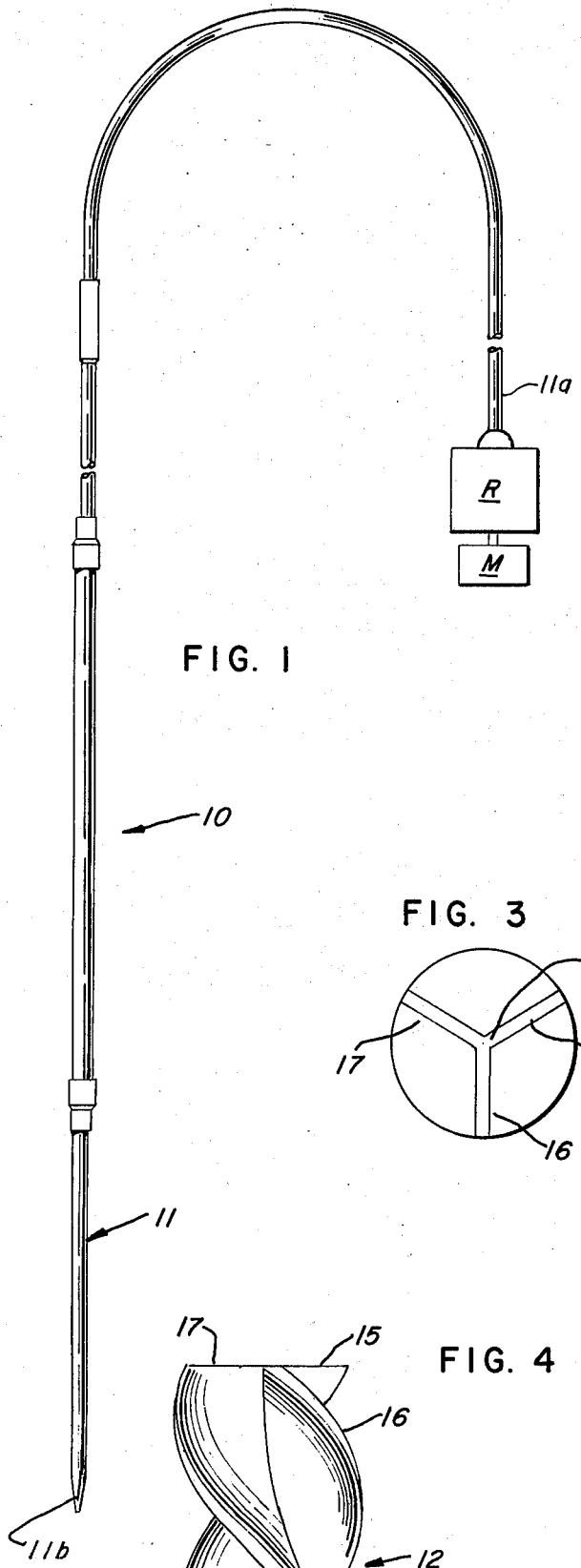
FIG. 1
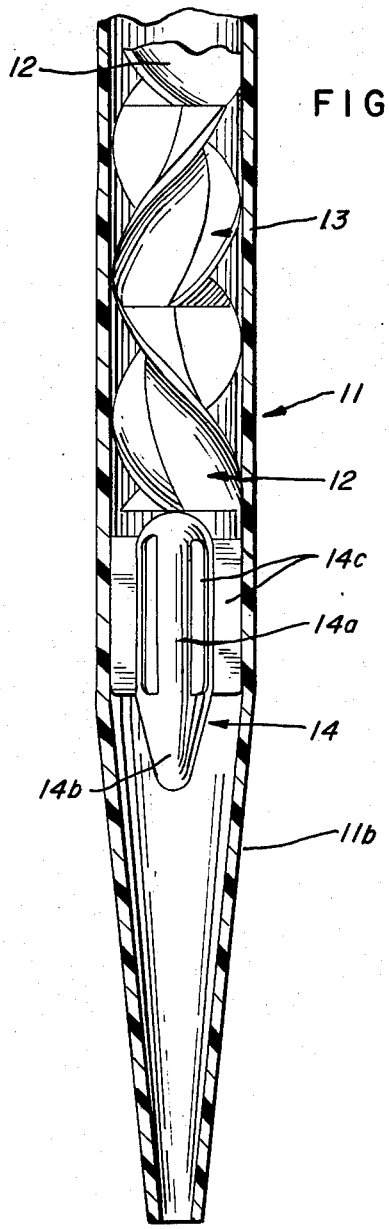
FIG. 2
FIG. 3
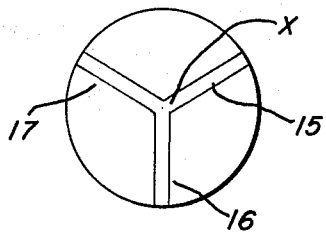
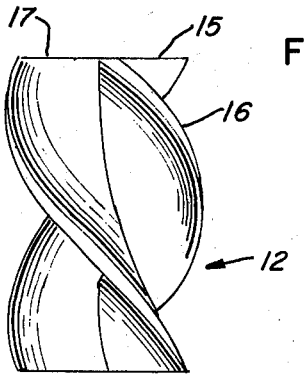
FIG. 4
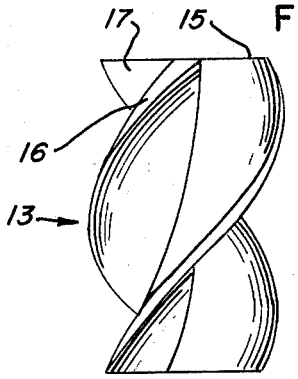
FIG. 5

DOSING APPARATUS

BACKGROUND OF THE INVENTION

The manual handling of a plurality of receptacles containing predetermined amounts of sample fluids preparatory to the latter being subjected to numerous analytical tests has heretofore been a problem requiring an inordinate amount of care and dexterity on the part of the persons performing the tests. Where numerous samples are to be prepared from a single specimen, the skill and accuracy of the person in preparing such samples has a profound effect on the correctness of the ultimate test results. The manual aspirating and dispensing of predetermined amounts of the specimen oftentimes inadvertently subjected the specimen and/or sample amounts to contamination.

It has heretofore been known from studies made of various flow patterns or profiles caused by the laminar flow of one fluid into a dissimilar second fluid that the resulting profiles for given fluids under similar operating conditions normally had a characteristic substantially parabolic configuration which occupied a long section of the tubular member, commonly referred to as a mixing region. In situations, however, wherein exact amounts of a fluid are to be aspirated and dispensed for purposes of making accurate test samples, it is imperative that intermixing of the sample fluid with the buffer fluid of a reversible pump be inhibited as much as possible and whatever intermixing occurs within the tubular member should be confined to a very short mixing region. The apparatus herein disclosed is directed towards achieving this result.

Prior devices of this general type have heretofore been provided; however, they have been costly and/or fragile, and have been impractical and incapable of achieving the desired results.

SUMMARY OF THE INVENTION

Thus, it is an object of this invention to provide a dosing apparatus which permits controlled aspirating and dispensing of exact amounts of a predetermined fluid.

It is a further object of the invention to provide a dosing apparatus which is of simple, inexpensive construction and effectively inhibits the intermixing of the aspirated and dispensed fluid with the pump buffer fluid.

It is a further object of this invention to provide a dosing apparatus which is capable of accommodating a variety of fluids.

It is a further object of this invention to provide a dosing apparatus wherein the fluid flow within the mixing region of the tubular member produces a scrubbing effect on the interior surface of the tubular member.

It is a still further object of this invention to provide a dosing apparatus wherein the mixing region within the tubular member has a minimal, controlled length which is well defined.

Further and additional objects will appear from the description, accompanying drawings and appended claims.

In accordance with one embodiment of the invention a dosing apparatus is provided which includes a tubular member connected at one end to a reversible pump for imparting controlled reverse flow of a buffer fluid within the member during aspirating and dispensing of a second fluid through the opposite end of the member.

Positioned within the tubular member and adjacent the aspirating and dispensing end thereof is a deflector piece which is adapted to deflect the fluid during aspiration thereof towards the interior surface of the tubular member. Also positioned within the tubular member and in end-to-end relation with the deflector piece are a plurality of elongated baffle elements. The elements are arranged in end-to-end relation and each element is provided with a plurality of symmetrically arranged vanes. The vanes of successive elements are curved longitudinally in opposite directions. The outer edge portions of the vanes are adjacent the interior surface of the tubular member. The fluid flow past the baffle elements is subjected to abrupt changes in directions at each successive baffle element thereby producing a low (short) flow profile within the tubular member.

For a more complete understanding of the invention, reference should be made to the drawings wherein FIG. 1 is a fragmentary side elevational view of one form of the improved dosing apparatus with the reversible pump and drive motor therefor shown in diagrammatic form.

FIG. 2 is an enlarged, fragmentary, longitudinal sectional view of a portion of the dosing apparatus adjacent the aspirating and dispensing end thereof.

FIG. 3 is an end view of one of the baffle elements shown in FIG. 2.

FIG. 4 is a side elevational view of one of the baffle elements of FIG. 2 showing the vanes thereof curved longitudinally in one direction.

FIG. 5 is similar to FIG. 4 but showing the next successive baffle element wherein the vanes thereof are curved longitudinally in the opposite direction.

Figure 6:
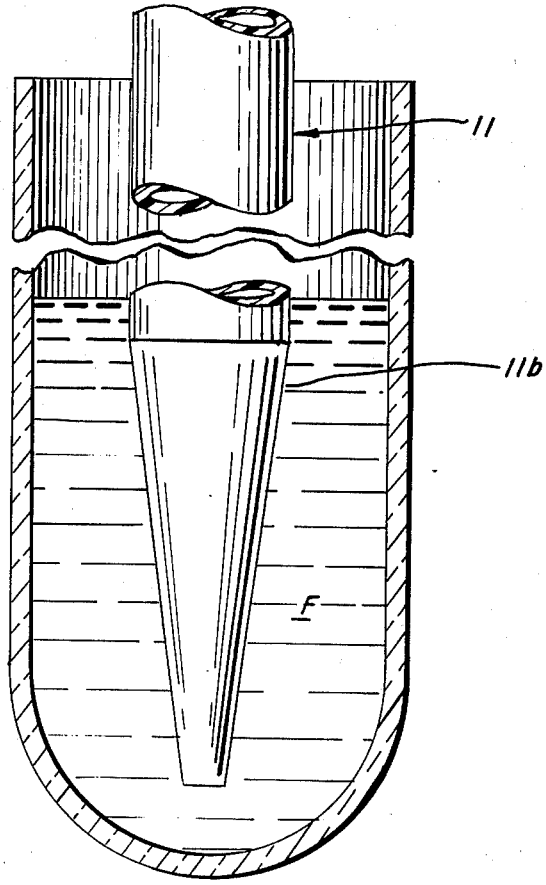
FIG. 6 is an enlarged fragmentary view of the aspirating and dispensing end of the tubular member shown immersed in a fluid contained within a receptacle.

Referring now to the drawings and more particularly to FIGS. 1 and 6, an improved dosing apparatus 10 is shown which is adapted for use in the controlled aspirating and dispensing of predetermined amounts of a fluid F. Testing and analyzing specimen samples in many instances require careful preparation of the sample in order to assure that the test results are accurate and meaningful. The apparatus in question is directed towards achieving accurate sample preparation and may be embodied in a sample preparation unit such as disclosed in pending application for U.S. Pat., Ser. No. 567,349 filed Apr. 11, 1975. Apparatus 10, however, is not intended to be limited for use only in such a sample preparation unit.

Apparatus 10 includes an elongated thin-walled tubular member 11 which is preferably formed of suitable heat-shrinkable plastic material which may be of any length desired. One end 11*a* of the member 11 is in direct communication with a reversible pump R. During operation of the apparatus 10, the pump imparts a controlled reverse flow to a buffer fluid disposed within the tubular member during aspirating and dispensing the specimen sample fluid through the opposite end 11*b* of the member 11, see FIG. 6. During aspirating of the fluid F, it is important that the fluid, which is subsequently dispensed from end 11*b*, not be contaminated by intermixing with the buffer fluid. Thus a means is disposed within the tubular member which will inhibit as much as possible the intermixing of the two fluids and confine such intermixing to a short well defined length of the tubular member, commonly known as the mixing region.

It is well known that the laminar flow within a given tube of one fluid into a second dissimilar fluid results in a flow profile which is attenuated and has a characteristic substantially parabolic configuration. In such a suituation the mixing region within the tubular member becomes inordinately long and thus undesirable. The means to be hereinafter disclosed breaks up the laminar flow into a multitude of short, non-uniform flow patterns which produce a low (short) flow profile, and also provide a scrubbing action within the member 11 and prevent the build-up of deposits within the member. In the embodiment illustrated in FIG. 2, the inhibiting means comprises a plurality of baffle elements 12 and 13 which are alternately arranged in end-to-end relation, and an elongated deflector piece 14 which is positioned between the endmost baffle element 12 and the aspirating and dispensing end 11*b* of the tubular member. Each baffle element 12 or 13 has a length relative to the inside diameter of the tubular member 11 which is within a range of from about 1.4 to above 1.9. The preferred ratio is approximately 1.7. Each baffle element has three symmetrically arranged vanes 15, 16 and 17 which extend outwardly from a central longitudinal axis X. The outer edge portions of each vane terminates adjacent the interior surface of the tubular member 11, as seen in FIG. 2. The vanes of baffle element 12 curve longitudinally in one direction through an angle within the range of from about 60° to about 210°. In a similar manner the vanes of baffle element 13 curve longitudinally in a like manner but in an opposite direction, so that as fluid flows past the plurality of baffle elements, the fluid will be subjected to an abrupt change of direction at each successive baffle element. Thus, in the area of the tubular element wherein the buffer fluid and specimen fluid intermix, a low flow profile will be created which in turn results in a short mixing region.

Figure 7:
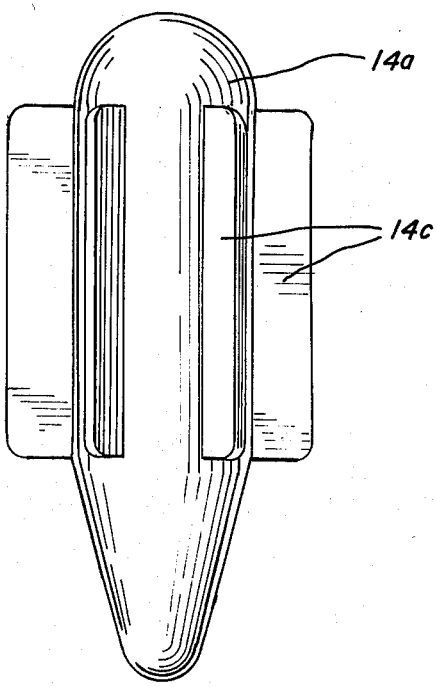
FIG. 7 is an enlarged side elevational view of one form of a deflector piece.
Figure 8:
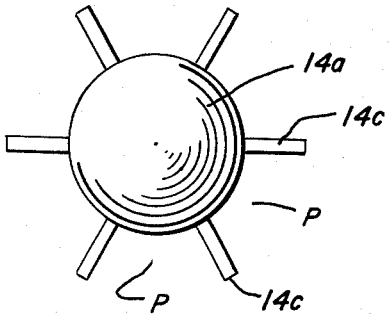
FIG. 8 is an end view of the deflector piece of FIG. 7.

To insure that the baffle elements will impart the optimum swirling motion to the aspirated fluid as it passes the baffle elements 12 and 13, a deflector piece 14 is provided which is positioned within the tubular member 11*b* in end-to-end relation with respect to the endmost element 12, see FIG. 2. Piece 14 includes an elongated core or central section 14*a* which has a tapered rounded end 14*b* facing towards the open end 11*b* of the tubular member 11. Radiating outwardly from the core 14*a* are a plurality of symmetrically arranged blades 14*c* which terminate adjacent the interior surface of the tubular member 11, see FIG. 2. The rounded end 14*b* of the core deflects the aspirated fluid outwardly away from the axis of the tubular member into the peripheral passageways P formed between adjacent blades 14*c*, see FIG. 8. At the upper end of the deflector piece 14, as seen in FIG. 2, the fluid flowing through the passageways P will undergo a slight commingling before passing through the plurality of baffle elements.

Besides forming fluid passageways P, the blades serve to center the core 14*a* within the tubular member 11 and provide reinforcement for the latter.

The reversible pump R, shown diagrammatically in FIG. 1, includes a driving mechanism M, such as for example, a solenoid, or a motor, the operation of which may be programmed by a computer or the like, not shown. One desirable example of a suitable mechanism is an electric linear motor. It is desirable that the pump produce a constant flow rate so that better control of the length of the mixing region can be attained.

In assembling the dosing apparatus 10, the deflector piece and the baffle elements are inserted in end-to-end relation into the interior of the tubular member 11 until the deflector piece 14 is disposed at the beginning of the tapered end 11*b* of the tubular member 11. Once the deflector piece and baffle elements are properly located within the tubular member, the exterior of the latter may be heated slightly thereby causing the tubular member to shrink slightly and snugly engage the outer edge portions of the vanes of each baffle element and the blades of the deflector piece.

While each baffle element is shown in FIG. 3 as embodying three symmetrically arranged vanes, the number thereof may be increased, if desired. By having at least three vanes, however, the baffle element is inherently strong and resists collapse.

Thus, it will be seen that a dosing apparatus has been provided which effectively inhibits intermixing of two fluids within a tubular member, thereby minimizing the length of the mixing region within the member. The dosing apparatus is capable of controlled handling of a variety of fluids.

We claim:

1. A dosing apparatus comprising an elongated tubular member connected at one end to a reversible pump for imparting controlled reverse flow of a first fluid within the tubular member during aspirating and dispensing of a second fluid through the opposite end of said member, and means disposed within said member for inhibiting intermixing of the fluids therein; said means comprising a plurality of elongated baffle elements arranged in end-to-end relation and disposed within said tubular member, and an elongated deflector piece disposed within said member adjacent the aspirating and dispensing end thereof and in end-to-end relation with the endmost one of said baffle elements; each baffle element being provided with a plurality of symmetrically arranged outwardly extending elongated vanes having the outer edge portions thereof adjacent the interior surface of said tubular member, the vanes of successive baffle elements being curved longitudinally in opposite directions through arcs greater than about sixty degrees whereby fluid flow through said plurality of baffle elements is subjected to an abrupt change of direction at each successive baffle element, and the flow of fluid through said dosing apparatus is made to acquire an approximate plug flow profile characteristic.

2. The dosing apparatus of claim 1 wherein each baffle element has at least three symmetrically arranged vanes, each vane being coextensive with the length of the baffle element.

3. The dosing apparatus of claim 1 wherein the arc of curvature of the vanes of each baffle element is within a range from about sixty degrees to about two hundred ten degrees.

4. The dosing apparatus of claim 1 wherein said baffle elements have substantially like longitudinal dimensions and the vanes of alternate baffle elements are curved longitudinally in the same direction.

5. The dosing apparatus of claim 4 wherein the ratio of the length of each baffle element to the interior diameter of said tubular member is within the range from about 1.4 to about 1.9.

6. The dosing apparatus of claim 1 wherein the outer edge portions of the vanes of said baffle elements are in frictional engagement with the interior surface of said tubular member.

7. The dosing apparatus of claim 1 wherein the reversible pump includes a linear drive motor.

8. The dosing apparatus of claim 1 wherein the aspirating and dispensing end of the tubular member is tapered.

9. The dosing apparatus of claim 1 wherein the deflector piece includes an elongated enlarged central section having a tapered first end portion disposed adjacent to the aspirating and dispensing end of the tubular member, and a plurality of symmetrically arranged blades radiating from said central section and frictionally contacting the interior surface of said tubular members.

10. The dosing apparatus of claim 9 wherein the deflector piece is disposed in abutting end-to-end relation with the endmost one of the baffle elements.

11. The dosing apparatus of claim 1 wherein the abrupt change in direction of fluid flow at each successive baffle element produces a scrubbing effect on the interior surface of the tubular member.

* * * * *